US011587382B1

(12) United States Patent
Valentine

(10) Patent No.: US 11,587,382 B1
(45) Date of Patent: Feb. 21, 2023

(54) PACKAGE DELIVERY SYSTEM AND METHOD OF USE

(71) Applicant: Quinn Valentine, Conroe, TX (US)

(72) Inventor: Quinn Valentine, Conroe, TX (US)

( * ) Notice: Subject to any disclaimer, the term of this patent is extended or adjusted under 35 U.S.C. 154(b) by 0 days.

(21) Appl. No.: 17/228,096

(22) Filed: Apr. 12, 2021

(51) Int. Cl.
*G07C 9/00* (2020.01)
*E06B 7/32* (2006.01)
*A47G 29/14* (2006.01)

(52) U.S. Cl.
CPC ..... *G07C 9/00896* (2013.01); *E06B 7/32* (2013.01); *A47G 29/14* (2013.01); *G07C 2009/00928* (2013.01)

(58) Field of Classification Search
CPC ..... G07C 9/00
See application file for complete search history.

(56) References Cited

U.S. PATENT DOCUMENTS

| | | | | |
|---|---|---|---|---|
| 4,836,352 | A * | 6/1989 | Tateno | G07F 17/12 177/25.15 |
| 9,652,912 | B2 * | 5/2017 | Fadell | G08B 29/185 |
| 10,613,533 | B1 * | 4/2020 | Payson | G06Q 10/087 |
| 10,755,511 | B2 * | 8/2020 | Eichenblatt | G07C 9/00309 |
| 10,878,647 | B2 * | 12/2020 | Kane | A47G 29/141 |

* cited by examiner

*Primary Examiner* — K. Wong
(74) *Attorney, Agent, or Firm* — Leavitt Eldredge Law Firm

(57) ABSTRACT

A package delivery system for secured delivery of packages without the need for a person to be present to accept them in person is disclosed. The package delivery system includes a vertical structure such as a wall, a door, and a garage door; a package delivery door dispositioned within the vertical structure; and one or more user devices in communication with the package delivery door via a network.

2 Claims, 4 Drawing Sheets

PACKAGE DELIVERY SYSTEM AND METHOD OF USE

BACKGROUND

1. Field of the Invention

The present invention relates generally to package delivery systems, and more specifically to a package delivery system that utilizes a package delivery door to provide secured delivery of packages when no one is present to accept packages.

2. Description of Related Art

Package delivery systems are well known in the art and are effective means to carry and deliver shipping containers, parcels, mail, and the like. Commonly in the art, package delivery systems are used by online retailers to send packages of their products to their customers. Over the last decade, online shopping has increased in volume exponentially, resulting in the increased demand for package delivery systems.

One of the problems commonly associated with package delivery systems is their lack of security. For example, packages are often dropped off on a doorstep or other entryway when no one is available to accept them in person. As a result, packages are left unsupervised and thus are vulnerable to theft by porch pirates. While there have been attempts at ensuring the secured delivery of packages, such as leaving packages at a monitored package facility for the recipient to accept, these attempts are often extremely inconvenient for the recipient. For example, recipients are often required to travel to the package facility to pick up their package in person during store hours, which may clash with the recipient's schedule.

Hence, it would be advantageous to have a system and method that provides for secured delivery of packages without the need for a person to be present to accept them in person, thereby providing for improving user convenience.

Accordingly, although great strides have been made in the area of package delivery systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
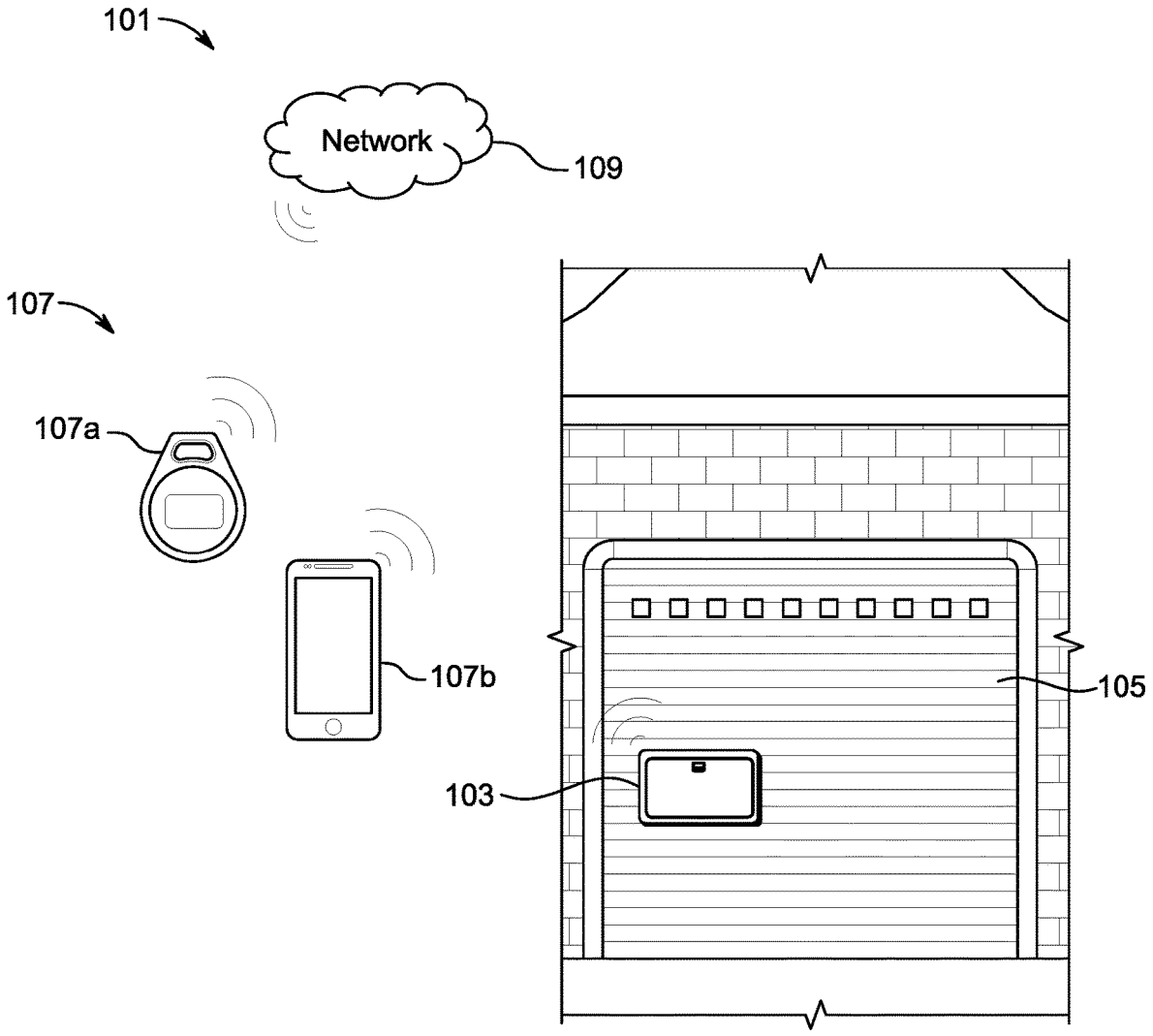
FIG. 1. is a schematic of a package delivery system in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional package delivery systems. Specifically, the system of the present invention provides for a means to deliver packages securely without the need for a person to be present to accept the packages in person. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a schematic of a package delivery system 101 in accordance with a preferred embodiment of the present application. It will be appreciated that the package delivery system 101 overcomes one or more of the above-listed problems commonly associated with conventional package delivery systems. In addition, it should be appreciated that the package delivery system 101 may vary based on aesthetical, functional, or manufacturing considerations.

In the contemplated embodiment, the package delivery system 101 includes a package delivery door 103 installed inside a vertical structure 105 such as a wall or door (e.g., a garage door as shown in FIG. 1). The package delivery door 103 is configured to be openable and closeable to allow packages to pass therethrough. It should be appreciated that the package delivery door 103 may be integrally formed as a unitary, one-piece construction with the vertical structure 105. Likewise, it should be appreciated that the package delivery door 103 may be separately formed and engaged with the vertical structure 105. Further, it should be appreciated that although the package delivery door 103 is shown on the bottom portion of the vertical structure 105, it is contemplated that the package delivery door 103 could vary in location, size, style, and the like.

The package delivery system 101 also includes one or more user devices 107 in communication with the package delivery door 103 via a network 109. It should be appreciated that the one or more user devices 107 may be embodied in other systems such as a key fob 107*a*, a smart phone 107*b*, a radio-frequency identification (RFID) card (not shown), a key chain, other hand-held device, or any other device suitable to facilitate communication with the package delivery door 103.

The network 109 may include one or more wired telecommunications, wireless telecommunications, or any combination or multiplicity thereof by which the one or more user devices 107 may communicate with the package delivery door 103. The network 109 may include, for example, one or more of a local area network (LAN), a wide area network (WAN), an intranet, an Internet, a public switched telephone network (PSTN), a metropolitan area network (MAN), a cellular or other mobile communication network, a BLUETOOTH® wireless technology connection, a wireless local area network (WLAN), a virtual private network (VPN) a near field communication (NFC) connection, and any combination or multiplicity thereof.

Figure 2A:
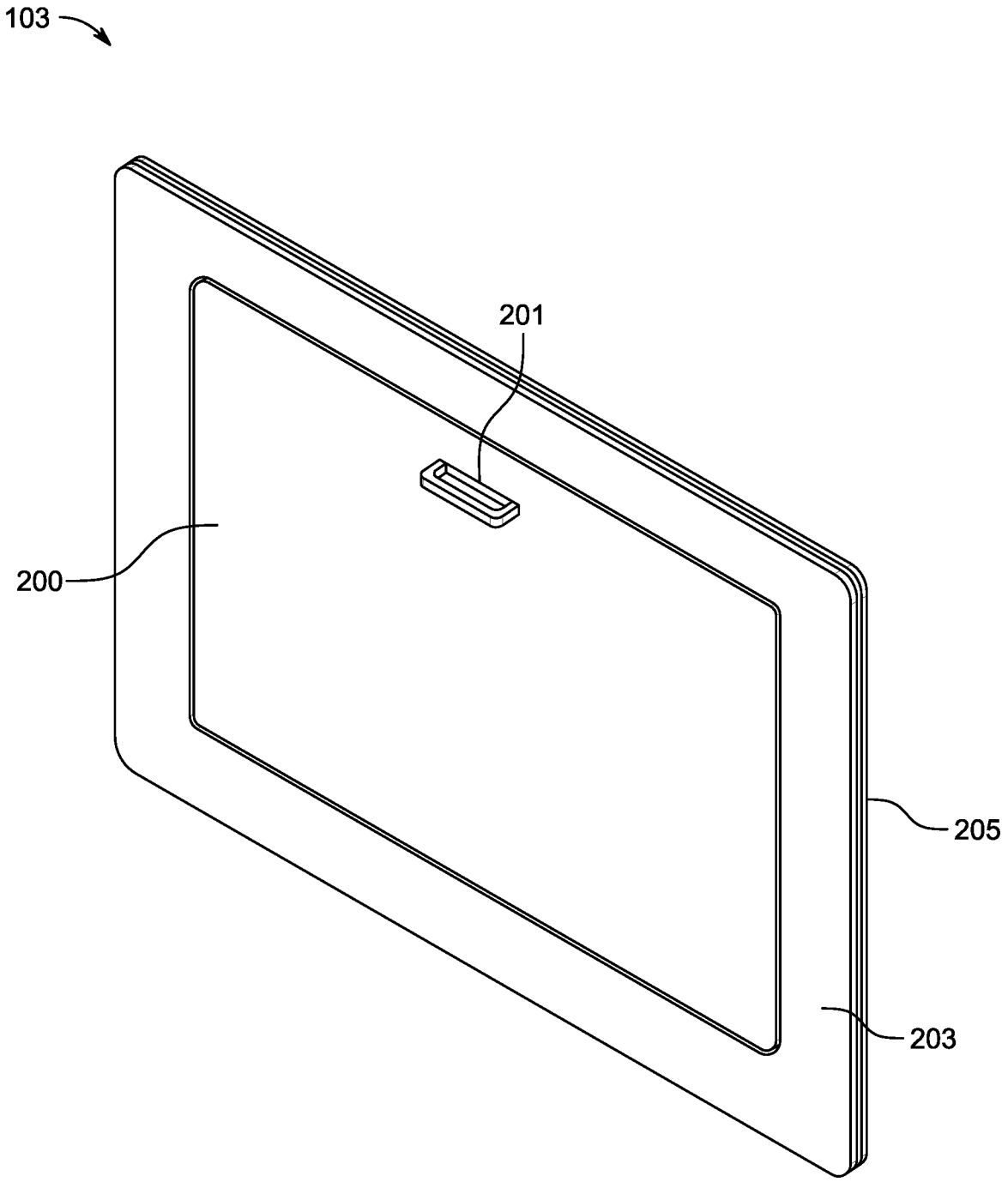
FIG. 2A is a perspective view of the package delivery apparatus of FIG. 1 in a closed configuration in accordance with one or more aspects of the present application.
Figure 2B:
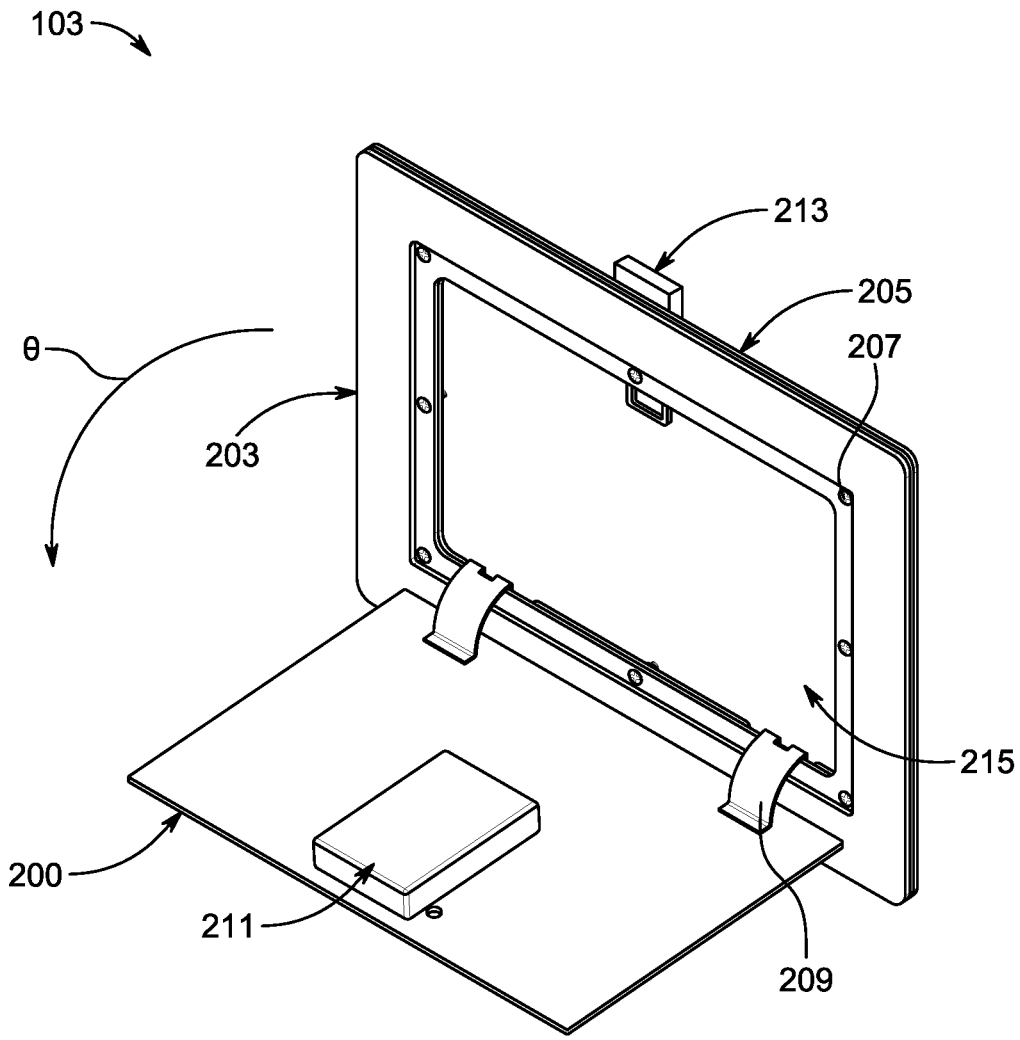
FIG. 2B is a perspective view of the package delivery apparatus of FIG. 1 in an open configuration in accordance with one or more aspects of the present application.

In FIGS. 2A and 2B, perspective views of the package delivery door 103 in a closed and open configuration, respectively, are depicted. The package delivery door 103 includes a door panel 200, a handle 201, an exterior frame 203, an interior frame 205, one or more fasteners 207, and one or more hinges 209. The exterior frame 203 and the interior frame 205 are configured to define a door opening 215 to allow the insertion of one or more packages.

The one or more hinges 209 are configured to allow the door panel 200 to open at an angle (θ), preferably at 105 degrees, and close flush with the exterior frame 203. It should be appreciated that although the one or more hinges 209 is shown along the bottom portion of the package delivery door 203, it is contemplated that the one or more hinges 209 may vary in location to facilitate the opening and closing of the door panel 200.

It should also be appreciated that the one or more fasteners 207 may include, without limitation, bolts, rivets, nails, screws, other fasteners, or any combination or multiplicity thereof.

The package delivery door 103 also includes a controller 211 and a latch 213. The controller 211 is configured to engage and disengage the latch 213 based on communication received from the one or more user devices 107. It should be appreciated that the controller 211 may include one or more user settings (not shown) that a recipient can choose from to control timing of the engagement and disengagement of the latch 213. For example, a recipient may select an auto-lock setting that directs the controller 211 to engage the latch 213 once the door panel 200 closes. In another example, a recipient may select a setting that directs the controller to engage the latch 213 thirty seconds after the door panel 200 closes 213.

In some embodiments, it should be appreciated that during use, when a delivery person having the one or more user devices 107 is in proximity to the package delivery door 103, the controller 211 directs the latch 213 to disengage, thereby allowing the delivery person to open the package delivery door 103. The delivery person may insert one or more packages through the door opening 215 and then close the package delivery door 103. Once closed, the controller 211 directs the latch to engage.

In alternative embodiments, it should be appreciated that during use, when a delivery person does not have the one or more user devices 107, the recipient may employ his or her user device, such as smart phone 107*b*, to remotely disengage the latch 213. Once the latch is disengaged, the delivery person may open the package delivery door 103 and insert one or more packages through the door opening 215.

In some embodiments, it should be appreciated that during use, the recipient may require the delivery person to engage the latch 213 after delivering one or more packages through the package delivery door 103 via the one or more user devices 107.

It should also be appreciated that one of the unique features believed characteristic of the present application is that the one or more user devices 107 and the controller 211 eliminate the need for a person to be present physically to accept packages and allow packages to be delivered securely.

Figure 3:
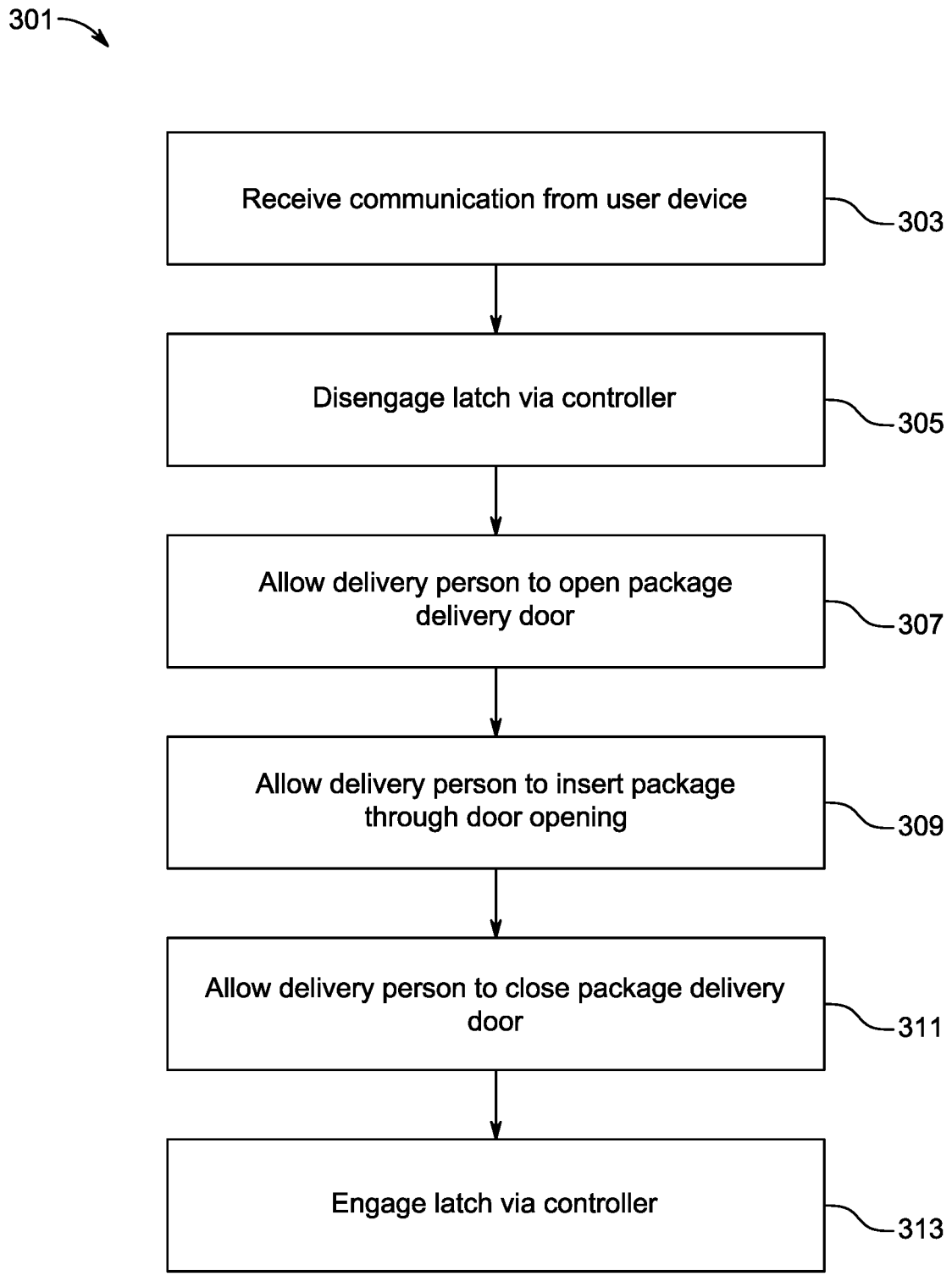
FIG. 3 is a flowchart of a method of use of the package delivery system of FIG. 1.

In FIG. 3, a flowchart 301 depicts a simplified method of use associated with the package delivery system 101. During use, when communication from the one or more user devices is received, the controller disengages the latch, as shown with boxes 303, 305. The delivery person may then open the package delivery door, insert one or more packages through the door opening, and close the package delivery door, as shown with boxes 307-311. The controller then engages the latch, as shown with box 313. It should be appreciated that the engagement of the latch may be based upon the one or more user settings selected by the recipient.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

The invention claimed is:

1. A package delivery system for secured delivery of packages without the need for a person to be present to accept them in person, comprising:

a vertical structure;

a remote wireless device positioned at a remote distance from the vertical structure, the remote wireless device is a cell phone; and a package delivery door dispositioned within the vertical structure, the package delivery door comprising:

a door panel;

a handle;

an exterior frame;

an interior frame positioned adjacent to the exterior frame and adjacent to an opening created when the door panel is in an open position;

one or more fasteners extending through the interior frame;

one or more hinges configured to rotatably move the door panel, the one or more hinges are extending from the interior frame to an interior surface of the door panel;

a latch secured to the exterior frame, the latch is configured to secure the door panel in a fixed position; and a controller, the controller having one or more user settings, the controller is secured on an inside surface of the door panel, the controller is in communication with the latch and in wireless communication with the remote wireless device, the latch is open/closed by command of the remote wireless device for a predetermined duration, the predetermined duration is selected by a user;

wherein the door panel closes such that the interior surface of the door panel engages with an exterior surface of the interior frame such that the one or more fasteners are positioned between the exterior surface of the interior frame and the interior surface of the door panel; and wherein the one or more hinges and the controller are concealed from an exterior of the package delivery door when the door panel is in a closed position;

wherein the exterior frame and the interior frame are configured to define a door opening to allow the insertion of one or more packages therethrough;

wherein the controller is configured to engage and disengage the latch, which in turn locks and unlocks the door panel to the exterior structure; and wherein the one or more user settings include timer settings for the engagement and disengagement of the latch;

wherein the remote wireless device is in communication with the package delivery door via a network; and wherein the remote wireless device is configured to direct the controller to engage and disengage the latch.

2. The package delivery system of claim 1, wherein the vertical structure includes a wall, a door, and a garage door.

* * * * *